US011918848B2

(12) United States Patent
Chang et al.

(10) Patent No.: US 11,918,848 B2
(45) Date of Patent: Mar. 5, 2024

(54) SLAT HAVING TRUSS STRUCTURE

(71) Applicants: Bo Young Chang, Seoul (KR); Min Wung Kim, Incheon (KR)

(72) Inventors: Bo Young Chang, Seoul (KR); Min Wung Kim, Incheon (KR)

(73) Assignee: Bo Young Chang, Seoul (KR)

( * ) Notice: Subject to any disclaimer, the term of this patent is extended or adjusted under 35 U.S.C. 154(b) by 112 days.

(21) Appl. No.: 17/618,539

(22) PCT Filed: Jun. 8, 2020

(86) PCT No.: PCT/KR2020/007378
§ 371 (c)(1),
(2) Date: Dec. 13, 2021

(87) PCT Pub. No.: WO2020/256321
PCT Pub. Date: Dec. 24, 2020

(65) Prior Publication Data

US 2022/0355160 A1 Nov. 10, 2022

(30) Foreign Application Priority Data

Jun. 15, 2019 (KR) ..... 10-2019-0071156

(51) Int. Cl.
*A63B 22/02* (2006.01)

(52) U.S. Cl.
CPC ..... *A63B 22/0207* (2015.10); *A63B 22/0285* (2013.01)

(58) Field of Classification Search
CPC . A63B 22/0207; A63B 22/0285; A63B 22/02; A63B 22/0214; A63B 22/0221; A63B 22/0228; A63B 22/0235; A63B 22/0242; A63B 22/025; A63B 22/0257; A63B 22/0264
See application file for complete search history.

(56) References Cited

U.S. PATENT DOCUMENTS

| | | | | |
|---|---|---|---|---|
| 9,452,314 | B2 * | 9/2016 | Hou | A63B 22/0214 |
| 10,183,191 | B2 * | 1/2019 | Astilean | B62M 1/34 |
| 10,537,766 | B2 * | 1/2020 | Cei | A63B 22/0046 |
| 11,007,404 | B2 * | 5/2021 | Yoo | A63B 22/0285 |

(Continued)

FOREIGN PATENT DOCUMENTS

| | | | |
|---|---|---|---|
| KR | 101660909 | B1 | 9/2016 |
| KR | 1020170121682 | A | 11/2017 |

(Continued)

*Primary Examiner* — Megan Anderson
(74) *Attorney, Agent, or Firm* — NKL LAW; Jae Youn Kim

(57) ABSTRACT

Proposed is a slat having a truss structure, the slat including: a main body provided with a stepping part which receives the load of a user, and a coupling part which is formed on both sides of the stepping part and may be fixed to a track belt; and a truss part connected to the stepping part so as to distribute the load applied to the main body. Thus, since the load applied to the stepping part is distributed by a diagonal member part and a chord member part of the truss part, the bending of the main body caused by the load is minimized, and thus damage to the main body caused by the load may be prevented.

4 Claims, 11 Drawing Sheets
(3 of 11 Drawing Sheet(s) Filed in Color)

(56) References Cited

U.S. PATENT DOCUMENTS

| | | | | |
|---|---|---|---|---|
| 2018/0104534 | A1 | 4/2018 | Erkelenz et al. | |
| 2018/0214735 | A1 | 8/2018 | Astilean et al. | |
| 2020/0009418 | A1* | 1/2020 | Lo | A63B 22/0235 |

FOREIGN PATENT DOCUMENTS

| | | | |
|---|---|---|---|
| KR | 1020190006234 | A | 1/2019 |
| KR | 10-2062492 | B1 | 1/2020 |

* cited by examiner

| Displacement | A | B | C |
|---|---|---|---|
| | -2.6mm | -2.6mm | -2.5mm |

| Displacement | A | B | C |
|---|---|---|---|
| | -1.6mm | -1.6mm | -1.6mm |

| Displacement | A | B | C |
|---|---|---|---|
| | -3.3mm | -3.1mm | -3.0mm |

| Displacement | A | B | C |
|---|---|---|---|
| | -4.2mm | -4.1mm | -4.0mm |

| Displacement | A | B |
|---|---|---|
| | -9.6mm | -9.4mm |

| Displacement | A | B |
|---|---|---|
| | -6.9mm | -6.9mm |

SLAT HAVING TRUSS STRUCTURE

TECHNICAL FIELD

The present invention relates to a slat having a truss structure.

BACKGROUND ART

A treadmill is an exercise machine for running or walking in one place indoors using track belts rotated in an infinite orbit, and is also referred as a running machine. Recently, in order to satisfy a variety of consumer needs, new kinds of treadmills are being developed.

As one example, a treadmill having a slat track belt structure is being developed so as to reproduce the landing effect on an actual track. The slat track belt structure includes two track belts disposed in parallel to be spaced apart from each other by a designated distance, and a plurality of slats configured to connect the two track belts. The slats are arranged along the track belts. A user may exercise while contacting the slats instead of the track belts, and may thus experience exercise like on an actual track, compared to exercising on the conventional treadmill having a simple track belt structure.

However, the slats must support the load of the user and absorb shock during exercise, and thus, when the strength of the slats is equal to or lower than a designated degree, the slats may be excessively bent or damaged.

DISCLOSURE

Technical Problem

Therefore, the present invention has been made in view of the above problems, and it is an object of the present invention to provide a slat having a truss structure which may support the load of a treadmill user without being bent or damaged by the load.

Technical Solution

In accordance with the present invention, the above and other objects can be accomplished by the provision of a slat having a truss structure moved along track belts, the slat including a main body including a stepping part configured to receive a load of a user, coupling parts formed at both ends of the stepping part so as to be fixed to the track belts, and a truss part connected to the stepping part so as to distribute the load applied to the main body. The truss part may include a chord member part spatially spaced apart from the stepping part by a designated distance and a diagonal member part configured to connect the chord member part and the stepping part, and the chord member part may be formed to have a curved surface convex in a direction away from the stepping part. The diagonal member part may include first unit diagonal members configured to connect an inner surface of the chord member part to the stepping part, each of the first unit diagonal members may include at least one first diagonal member inclined in a first direction and arranged in a length direction of the chord member part and the stepping part, and at least one second diagonal member inclined in a second direction opposite to the first direction and arranged in the length direction of the chord member part and the stepping part, one side of the least one first diagonal member may be connected to one side of the at least one second diagonal member, and one sides and remaining sides of the at least one first diagonal member and the at least one second diagonal member may be respectively connected to the stepping part and the chord member part so as to form a triangular truss structure.

The diagonal member part may further include second unit diagonal members provided adjacent to the first unit diagonal members and configured to connect ends of the chord member part to the stepping part and the coupling parts.

A width of the truss part may be smaller than a width of the main body.

One side surface and a remaining side surface of the main body in a width direction thereof may be inclined in the same direction.

Advantageous Effects

In a slat having a truss structure according to one embodiment of the present invention, when the load of a user is vertically applied to a stepping part, compressive force is applied to first diagonal members and second diagonal members of first unit diagonal members, and tensile force is applied to a chord member part. Therefore, the load vertically applied to the stepping part is distributed through a truss part, and thus, bending of the stepping part may be minimized and damage to the slat may be prevented.

DESCRIPTION OF DRAWINGS BRIEF DESCRIPTION OF THE DRAWINGS

The patent or application file contains at least one drawing executed in color. Copies of this patent or patent application publication with color drawing(s) will be provided by the Office upon request and payment of the necessary fee.

In FIGS. 8A-8B, Z means displacements.

In FIGS. 9A-9D, Z means displacements.

MODE FOR INVENTION

Figure 1:
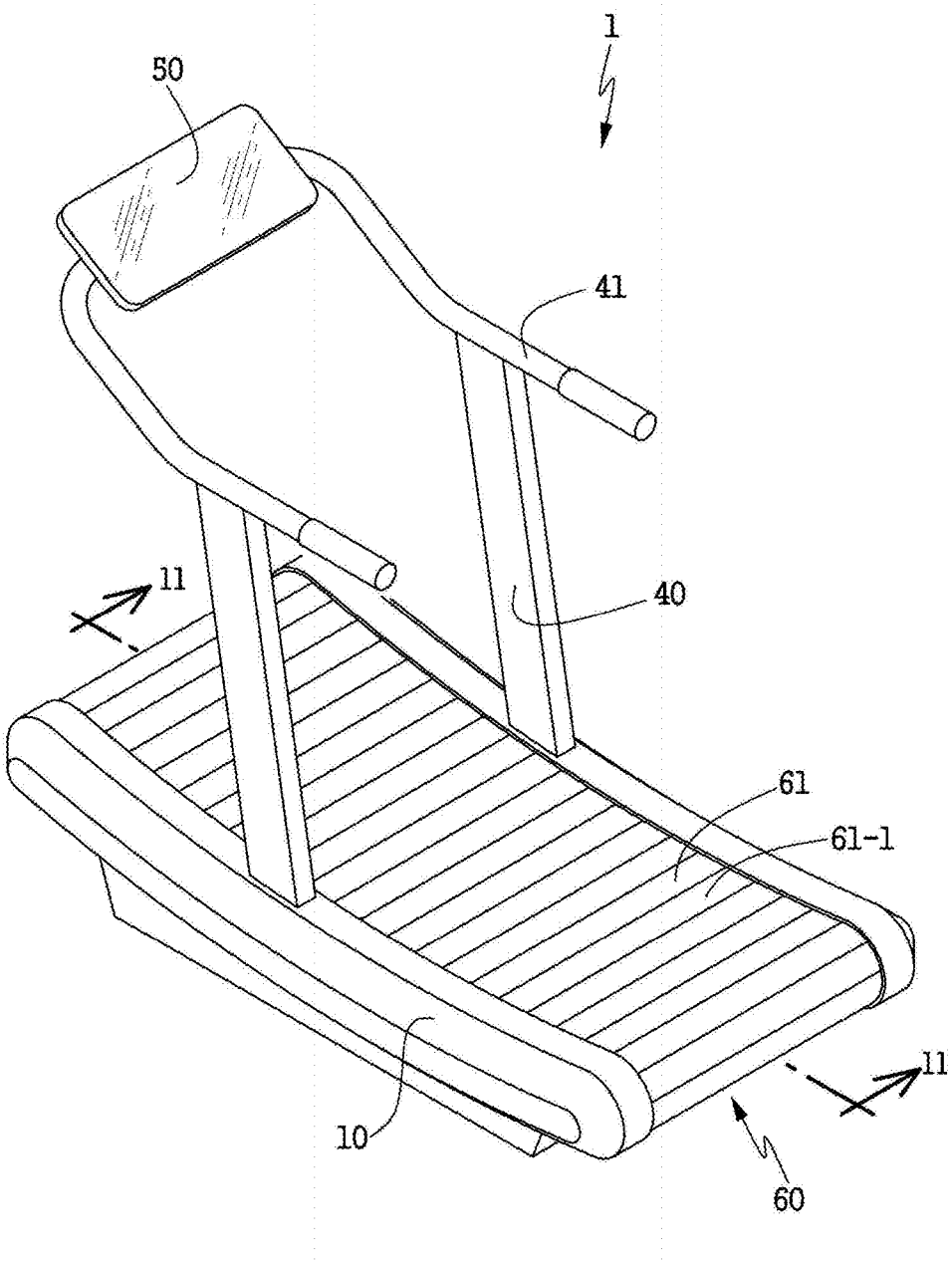
FIG. 1 is a schematic view illustrating a treadmill according to one embodiment of the present invention.

Hereinafter, reference will be made in detail to preferred embodiments of the present invention, examples of which are illustrated in the accompanying drawings. However, the disclosure of the invention is not limited to the embodiments set forth herein, and it will be understood that the embodiments of the present invention cover modifications, equivalents or alternatives which come within the scope and technical range of the invention. The embodiments below are provided to make the description of the present invention thorough and to fully convey the scope of the present invention to those skilled in the art. Therefore, the shapes of respective elements shown in the drawings may be exaggerated to more clearly describe the invention and, in the following description of the present invention, a detailed description of known functions and configurations incorporated herein will be omitted when it may make the subject matter of the present invention rather unclear.

In the following description of the embodiments, terms, such as "first" and "second", are used only to describe various elements, and these elements should not be construed as being limited by these terms. These terms are used only to distinguish one element from other elements.

The terminology used herein is for the purpose of describing particular embodiments only and is not intended to be limiting. Further, as used herein, the singular forms may be intended to include the plural forms as well, unless the context clearly indicates otherwise.

In the following description of the embodiments, terms, such as "comprising", "having", etc., are inclusive and therefore specify the presence of stated features, integers, steps, operations, elements, and/or components, but do not preclude the presence or addition of one or more other features, integers, steps, operations, elements, components, and/or combinations thereof.

Hereinafter, reference will be made in detail to various embodiments of the present invention, examples of which are illustrated in the accompanying drawings and described below. However, the present invention may be embodied in many alternative forms, and should not be construed as being limited to the embodiments set forth herein. In the following description of the embodiments with reference to the drawings, the same or similar elements are denoted by the same reference numerals even though they are depicted in different drawings.

A slat according to one embodiment of the present invention may be applied not only to a motorized treadmill operated based on a separate power source, such as a motor, but also to a non-motorized treadmill operated by user's landing force without any separate power source. Further, the slat may be applied to an apparatus installed between structures, such as track belts, so as to receive a load, and application of the slat is not limited to treadmills.

Hereinafter, the slat according to one embodiment of the present invention and a treadmill to which the slat is applied will be described with reference to FIGS. 1 to 7.

Figure 2:
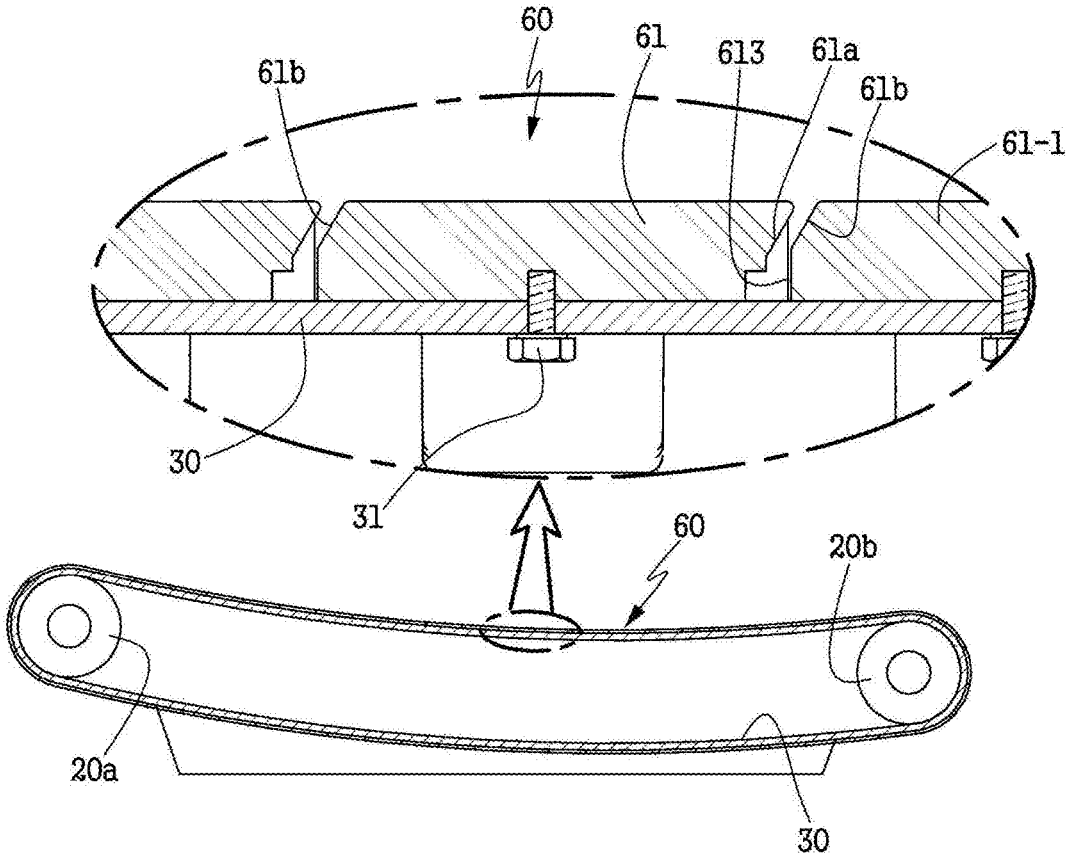
FIG. 2 is a cross-sectional view taken along line II-II of FIG. 1.
Figure 3:
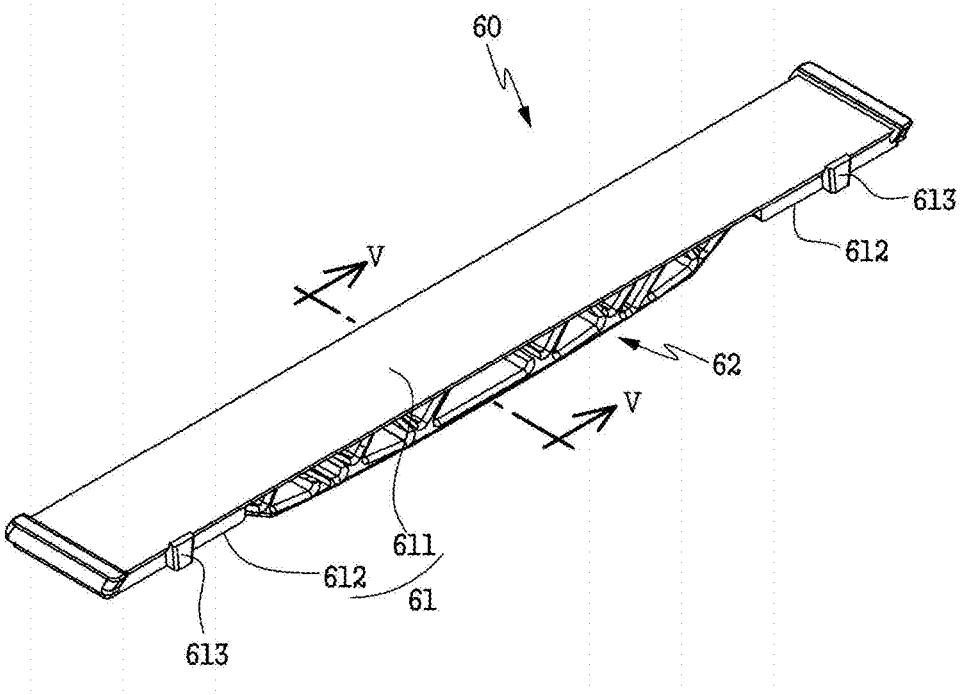
FIG. 3 is a perspective view illustrating a slat shown in FIG. 2.
Figure 4:
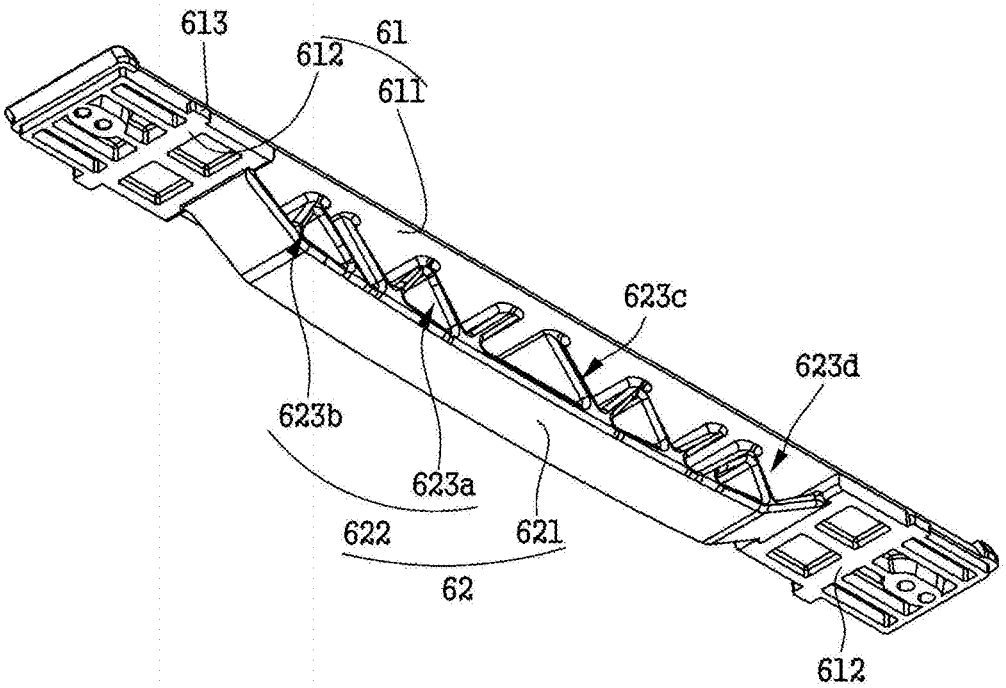
FIG. 4 is a perspective bottom view illustrating the slat shown in FIG. 3.
Figure 5:
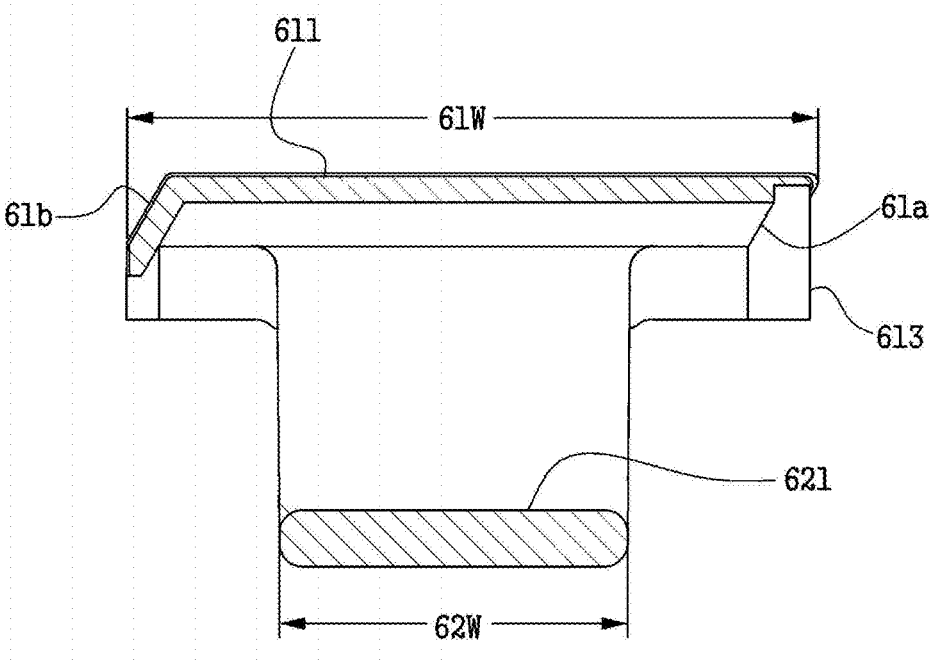
FIG. 5 is a cross-sectional view taken along line V-V of FIG. 3.
Figure 6:
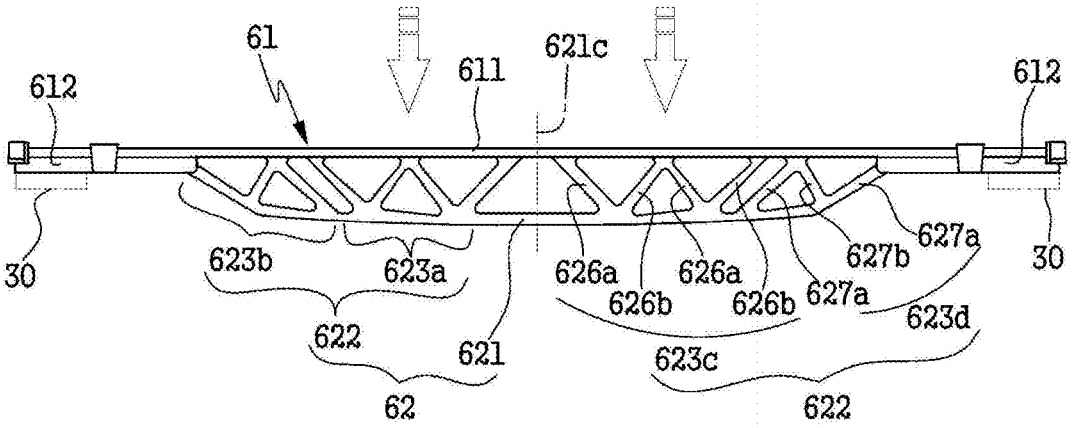
FIG. 6 is a front view illustrating the slat shown in FIG. 3.
Figure 7:
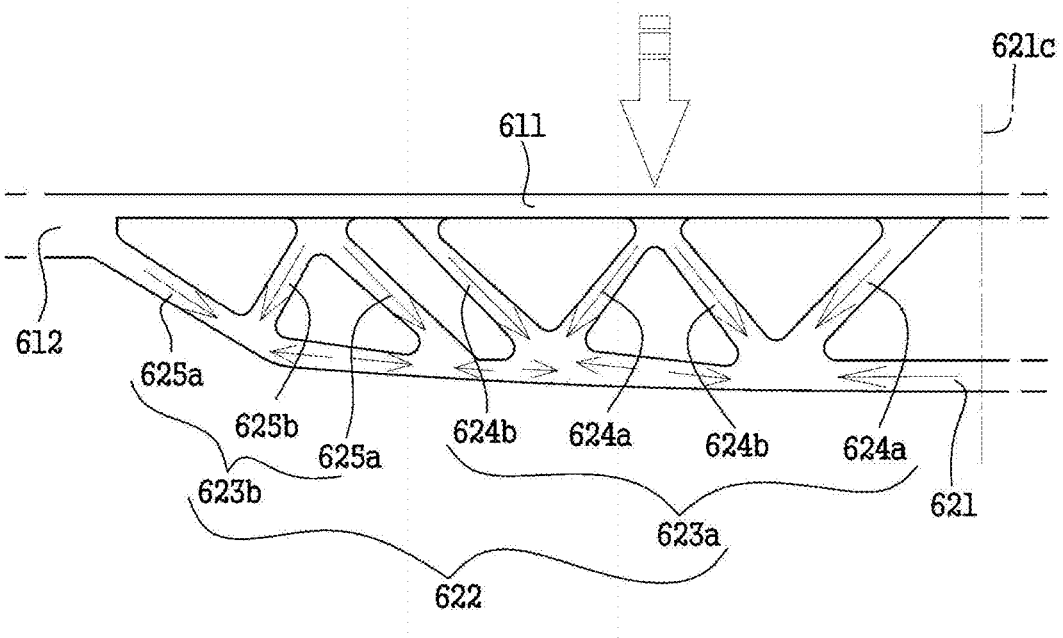
FIG. 7 is an enlarged view illustrating a first truss part and a second truss part shown in FIG. 6.

FIG. 1 is a schematic view illustrating a treadmill according to one embodiment of the present invention, FIG. 2 is a cross-sectional view taken along line II-II of FIG. 1, FIG. 3 is a perspective view illustrating a slat shown in FIG. 2, FIG. 4 is a perspective bottom view illustrating the slat shown in FIG. 3, FIG. 5 is a cross-sectional view taken along line V-V of FIG. 3, FIG. 6 is a front view illustrating the slat shown in FIG. 3, and FIG. 7 is an enlarged view illustrating a first truss part and a second truss part shown in FIG. 6.

First, referring to FIGS. 1 and 2, a treadmill 1 according to this embodiment includes a body 10 configured to support a first roller and a second roller, the first roller 20*a* disposed in the front portion of the body 10, the second roller 20*b* disposed in the rear portion of the body 10, track belts 30 configured to connect the first roller 20*a* and the second roller 20*b*, and one or more slats 60 arranged along the track belts 30. The treadmill 1 may further include a frame unit 40 connected to the body 10, and a display device (not shown) may be further disposed on the frame unit 40.

A working space (not shown) is formed inside the body 10, and protects elements disposed in the working space from external influences. An adjuster (not shown) configured to adjust the height, horizontality, etc. of the body 10 is installed on the lower surface of the body 10.

The working space (not shown) is formed inside the body 10, and protects the elements disposed in the working space from external influences. The adjuster (not shown) configured to adjust the height, horizontality, etc. of the body 10 is installed on the lower surface of the body 10.

In case that the treadmill according to the present invention is a motorized treadmill, the treadmill may further include a driving unit (not shown). The driving unit may include a motor, may be conductively connected to a controller 50, and may be operated under the control of the controller 50. Here, the controller 50 may control ON/OFF, the driving speed, the driving time, and the driving mode of the driving unit, etc. The controller 50 may be disposed on the frame unit 40.

The track belt 30 is paired with the first roller 20*a* and the second roller 20*b*, and is disposed at each of the left side and the right side of the body 10 based on a virtual user on the slats. The track belts 30, each of which is disposed at one side of the body, connect both ends of the first roller 20*a* and the second roller 20*b*. The track belts 30 may be moved in the body 10 by rotation of the first roller 20*a* and the second roller 20*b*.

The frame unit 40 is installed vertically at both sides of body 10, and a handle 410 is provided at the upper end of the frame unit 40 so as to be gripped by a user. The controller 50 may be disposed on the handle 41.

The detailed configurations of the body 10, the first handle 20*a*, the second handle 20*b*, the track belts 30, the frame unit 40 and the controller 50 according to this embodiment are the same as those of the conventional treadmill having the known configuration, and a detailed description thereof will thus be omitted.

Thereafter, the slat having a truss structure according to this embodiment will be described with reference to FIGS. 3 to 7.

The slat 60 having the truss structure according to this embodiment includes a main body 61 configured to be stepped on by a user and thus to receive the load of the user, and a truss part 62 configured to have the truss structure so as to distribute the load applied to the main body 61. The slat 60 is arranged along the track belts 60 so as to connect the two track belts. Thereby, the slat 60 may be continuously rotated along the track belts 30 in the form of an infinite orbit using the first roller 20*a* and the second roller 20*b*.

The main body 61 includes a stepping part 611 and coupling parts 612, forms the external appearance of the slat 60, and may be stepped on by an exerciser. The stepping part 611 and the coupling parts 612 may be formed integrally.

The stepping part 611, on which the exerciser may directly step, may have predetermined length and width, and the load of the user may be applied to the stepping part 611. The stepping part 611 has a predetermined thickness in the vertical direction.

The coupling parts 612 are formed at both ends of the stepping part 611, and extend outwards. The lower surface of the stepping part 611 comes into contact with the track belts 30, and fastening units 31 configured to pass through the track belts 30 may be fastened to the lower surface of the stepping part 611. Therefore, the main body 61 may be combined with the track belts 30 so as to be moved along the track belts 30.

The coupling parts 612 may have a predetermined thickness in the vertical direction, which is greater than the thickness of the stepping part 611, and the thicknesses of the coupling parts 612 and the stepping part 611 may be varied depending on the designs of the slat 60 and the track belts 30.

In this embodiment of the present invention, the main body 61 is arranged along the track belts 30, and one side surface 61*a* of the main body 61 disposed opposite a neighboring main body 61-1 and the other side surface 61*b* of the main body 61 are inclined in the same direction. The reason for this is to enable the direction of movement of the slats to be changed without interference between the main bodies 61 and 611 of the adjacent slats when the direction of movement of the slats using the first roller 20*a* and the second roller 20*b* is changed.

The truss part 62 having the truss structure configured to achieve load distribution includes a chord member part 621 spatially spaced apart from the stepping part 611, and a diagonal member part 622 configured to connect the chord member part 621 and the stepping part 611.

The truss part 62 may be located under the main body 61, and may have a smaller width 62W than the width 62W of the main body 61. The reason for this is to prevent the truss parts 62 of the adjacent slats from being interfered with each other when the direction of movement of the slats using the first roller 20*a* and the second roller 20*b* is changed. However, if the width 62W of the truss part is excessively smaller than the width 61W of the main body, the load-distributing function of the truss part may be deteriorated.

The chord member part 621 is located below the stepping part 611, and is spaced apart from the lower surface of the stepping part 611 by a designated distance so as to be opposite the lower surface of the stepping part 611. The chord member part 621 may be formed to have a curved surface convex in a direction away from the stepping part. In this case, the chord member part may be formed to have an arch structure so as to more effectively distribute force.

The diagonal member part 622 includes first unit diagonal members configured to connect the inner surface of the chord member part to the stepping part, each of the first unit diagonal members including at least one first diagonal member inclined in a first direction and arranged in the length direction of the chord member part and the stepping part, and at least one second diagonal member inclined in a second direction opposite to the first direction and arranged in the length direction of the chord member part and the stepping part, one side of the at least one first diagonal member is connected to one side of the at least one second diagonal member, and one sides and the other sides of the at least one first diagonal member and the at least one second diagonal member are respectively connected to the stepping part and the chord member part so as to form a triangular truss structure.

The diagonal member part 622 may further include second unit diagonal members 623*b* in addition to the first unit diagonal members 623*a*. Each of the first unit diagonal members 623*a* and the second unit diagonal members 623*b* includes at least one first member 624*a* or 625*a* and at least one second member 624*b* or 625*b*.

The first unit diagonal member 623*a* is located inside the chord member part 621 adjacent to a virtual longitudinal central line 621*c* of the chord member part 621.

The first diagonal member 624*a* of the first unit diagonal member 623*a* may be disposed to be inclined in the first direction, and may be arranged in the length direction of the slat in a space between the chord member part 621 and the stepping part 611. Here, the first direction is a direction of inclination from the stepping part 611 to the chord member part 621 towards the outside of the slat.

The second diagonal member 624*b* of the first unit diagonal member 623*a* may be disposed to be inclined in the second direction opposite to the first direction, and may be arranged in the length direction of the chord member part 621 and the stepping part 611. Here, the second direction is a direction of inclination from the stepping part 611 towards the inside of the chord member part 621.

The first diagonal member 624*a* and the second diagonal member 624*b* are connected to form a joint and are connected to the stepping part 611 and the chord member part 621 through the joint between the first diagonal member 624*a* and the second diagonal member 624*b*. A triangular space of the truss structure is formed between the first diagonal member 624*a* and the second diagonal member 624*b*.

The diagonal member part 622 may further include the second unit diagonal members 623*b*. The second unit diagonal members 623*b* are disposed at the outer regions of the chord member part 621 adjacent to the first unit diagonal members 623*a*. The ends of the chord member part 621 are connected to the stepping parts 611 by the second unit diagonal members 623*b*.

The first diagonal member 625*a* of the second unit diagonal member 623*b* is disposed to be inclined in the second direction so as to connect the chord member part 621 and the stepping part 611.

The second diagonal member 625*b* of the second unit diagonal member 623*b* is disposed to be inclined in the first direction so as to connect the chord member part 621 and the stepping part 611.

Here, the outermost second diagonal member 624*b* of the first unit diagonal member 623*a* and the innermost first diagonal member 625*a* of the second unit diagonal member 623*b* are spaced apart from each other by a designated distance to be opposite each other. The outermost second diagonal member 625*a* of the second unit diagonal member 623*b* connects the chord member part 621 and the coupling part 612.

These first unit diagonal member 623*a* and second diagonal member 625*a* are also provided at the other side of the chord member part based on the virtual central line 621*c*, and may thus be disposed at both sides, i.e., the left and right sides, of the chord member part symmetrically. The first unit diagonal member 623*a* disposed at one side and the first unit diagonal member 623*c* disposed at the other side are spaced apart from each other by a designated distance to be opposite each other. Here, the innermost first diagonal member 624*a* of the first unit diagonal member 623*a* disposed at one side and the innermost second diagonal member 626*b* of the first unit diagonal member 623*c* disposed at the other side are spaced apart from each other by a designated distance to be opposite each other, and a triangular space having the truss structure is formed between the first unit diagonal member 623*a* disposed at one side and the first unit diagonal member 623*c* disposed at the other side. That is, triangular spaces having the truss structure are formed due to disposition of the first diagonal members 624*a*, 625*a*, 626*a* and 627*a* and the second diagonal members 624*b*, 625*b*, 626*b* and 627*b* between the stepping part 611 and the chord member part 621. The stepping part 611 may be stably supported by the chord member part 621 by the first diagonal members and the second diagonal members configured to form the triangular spaces having the truss structure. The number of the first diagonal members and the second diagonal members and the number of the triangular spaces may vary depending on the length of the stepping part 611.

When the load of the user is vertically applied to the stepping part 611, compressive force is applied to the first diagonal members and the second diagonal members of the first unit diagonal members 623*a* and 623*c* and the second unit diagonal members 623*b* and 623*d*, and tensile force is applied to the chord member part 621 to which the lower portions of the first diagonal members and the second diagonal members are connected through the joints. Therefore, the load vertically applied to the stepping part 611 is distributed through the truss part 62, and thus, bending of the stepping part 611 may be minimized. That is, the strain of the stepping part 611 may be minimized.

Since the load applied to the stepping part 611 is distributed by the truss part 62, the stepping part 611 may withstand the load even when the thickness of the stepping part 611 in the vertical direction is smaller than the thickness of the coupling parts 612 in the vertical direction. Therefore, the stepping part 611 may have a smaller thickness than the thickness of the coupling parts 612 in the vertical direction, and thus, the cost to produce the main body 61 may be reduced.

Figure 8A:
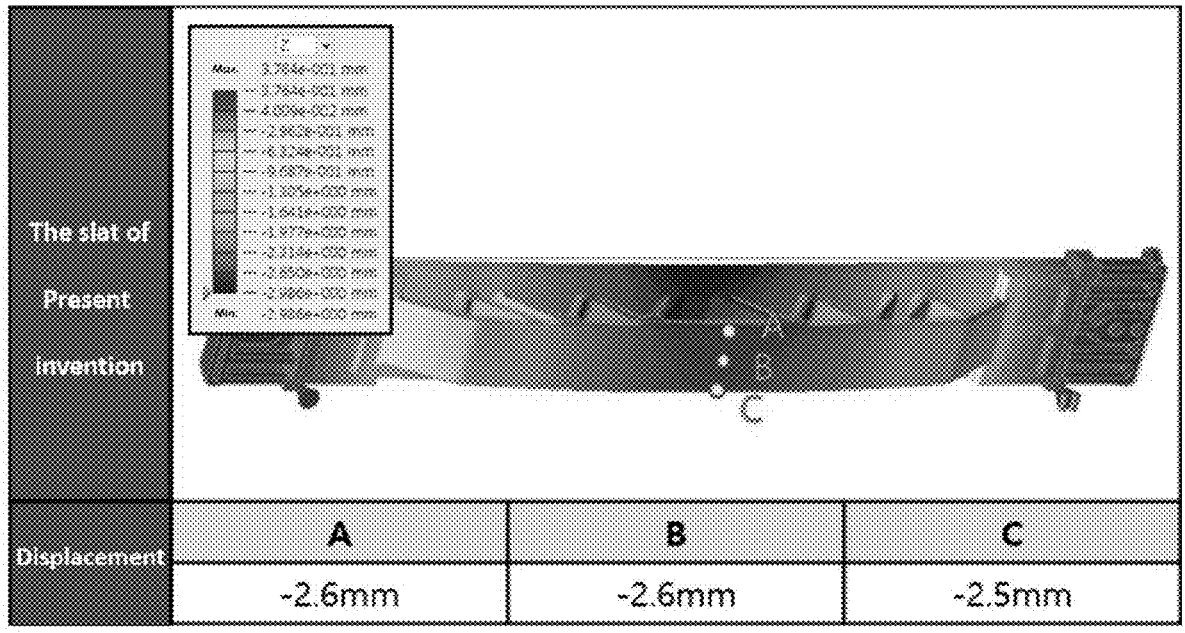
FIGS. 8A-8B are views representing numerical analysis results indicating displacements of the slat according to one embodiment of the present invention.
Figure 8B:
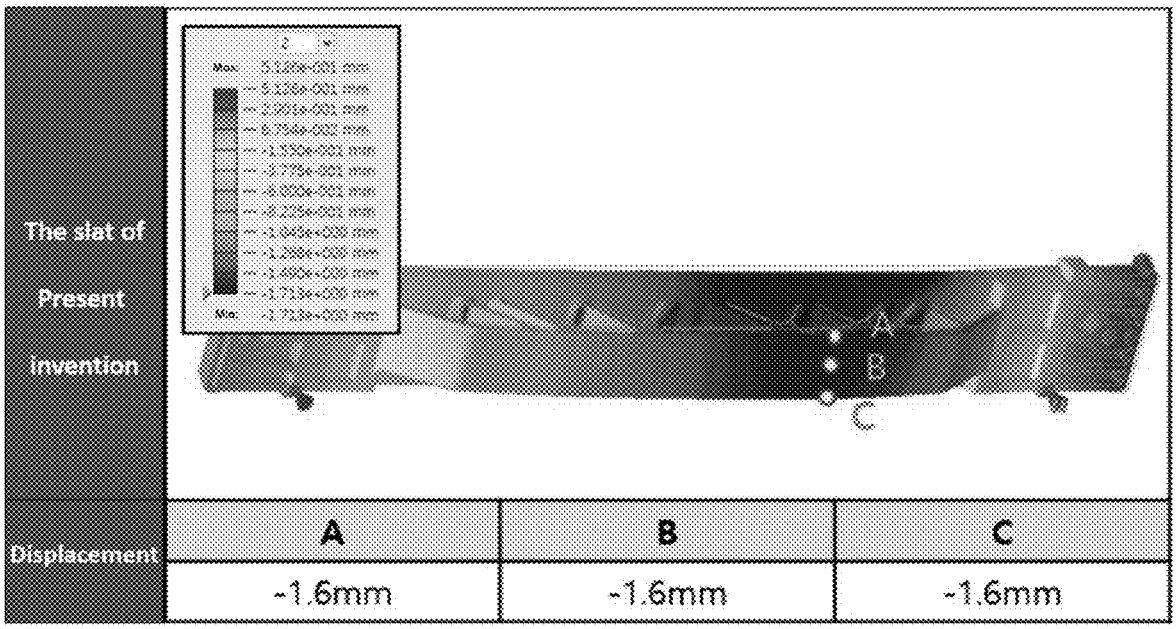

Numerical Analysis Results of Z-Directional Displacements of Slats According to Test Examples Example FIGS. 8A-8B represent numerical analysis results of the slat 1 including the main body and the truss part 62 according to one embodiment of the present invention.

Comparative Example 1

Figure 9A:
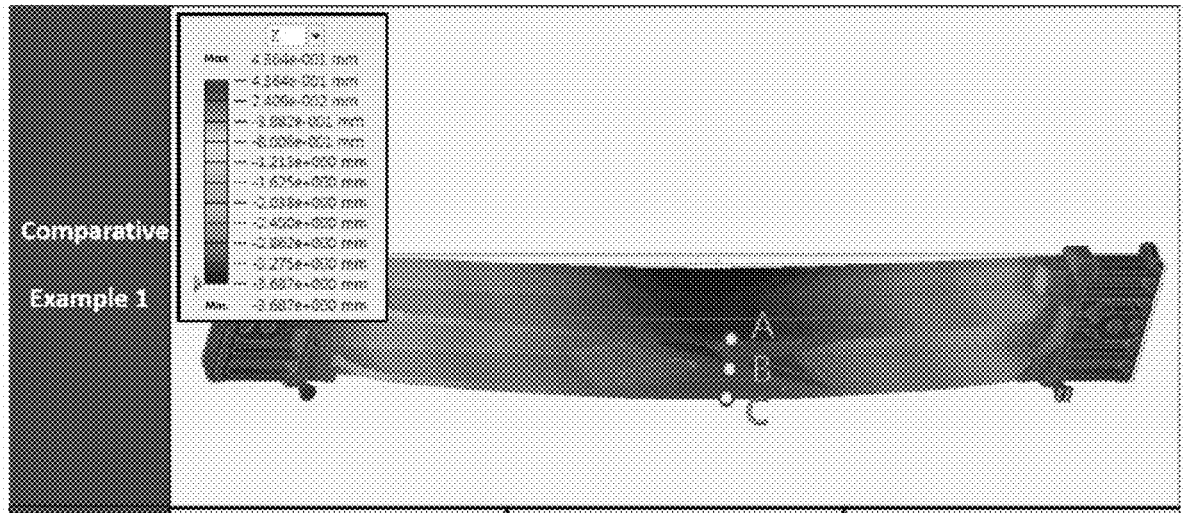
FIGS. 9A-9D are views representing numerical analysis results indicating displacements of slats according to comparative examples.

A slat was prepared by forming ribs under the main body according to Example of the present invention in the length direction of the main body, the ribs being arranged in the width direction of the main body, and connecting neighboring ribs by a cross bar (with reference to FIG. 9A).

Comparative Example 2

Figure 9B:
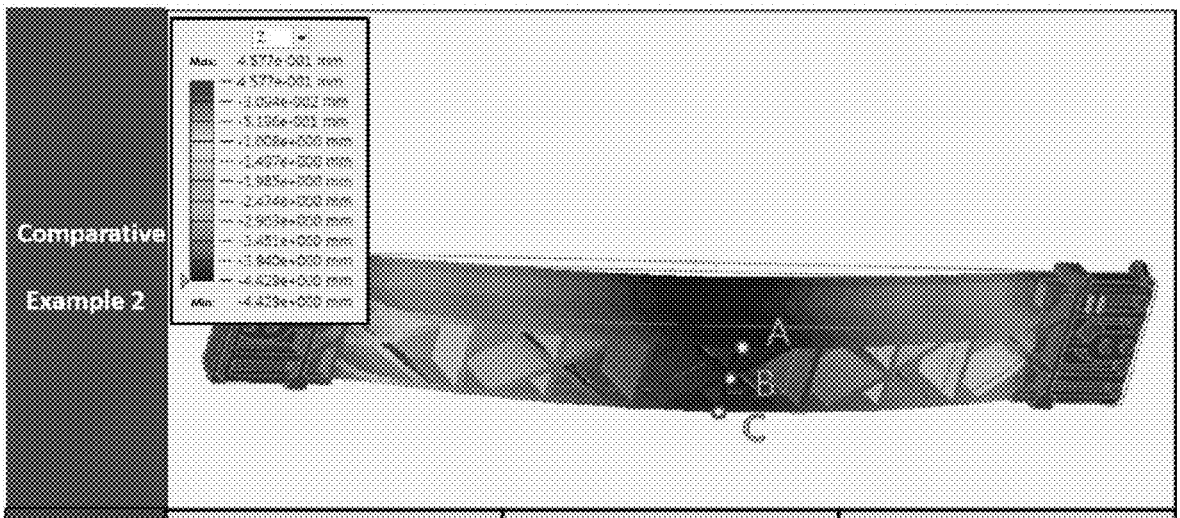

A slat was prepared by further disposing a vertical bar vertical to the ribs between neighboring ribs in addition to the structure of the slat according to Comparative Example 1 (with reference to FIG. 9B).

Comparative Example 3

Figure 9C:
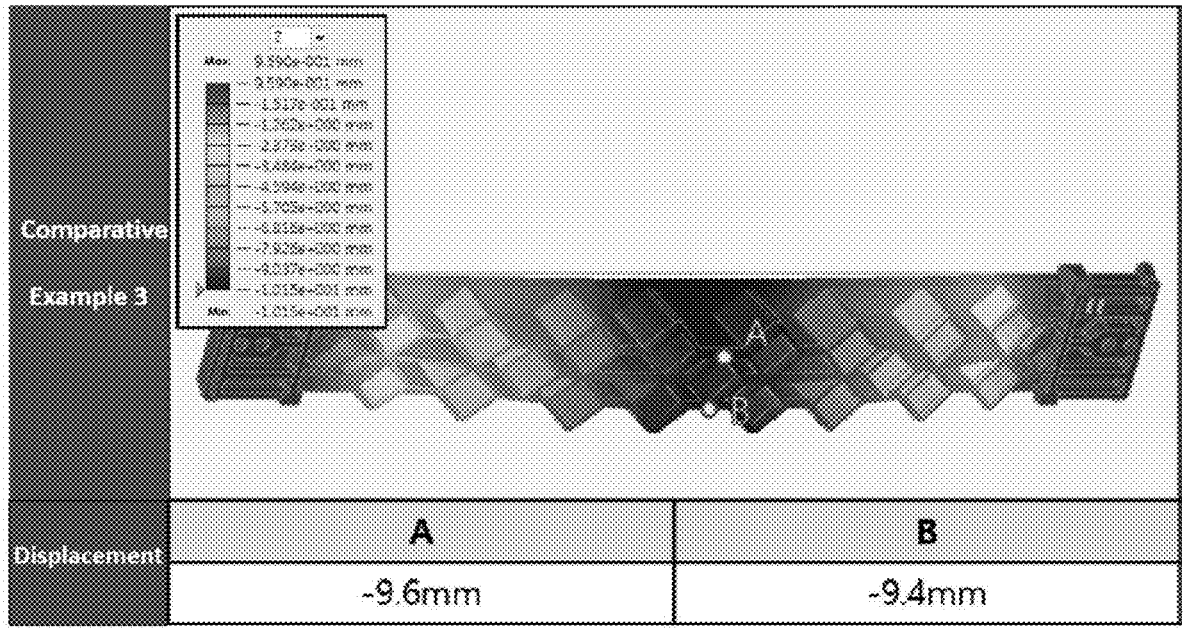

A slat was prepared by arranging rectangular pillars connected to each other under the main body of the slat according to Example of the present invention (with reference to FIG. 9C).

Comparative Example 4

Figure 9D:
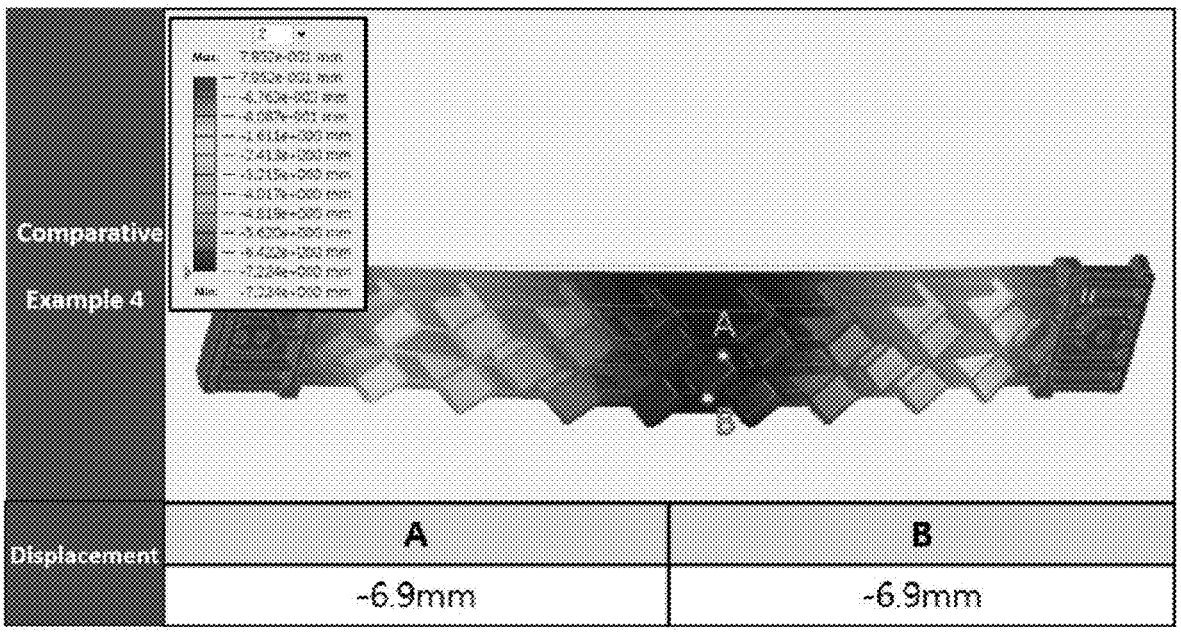

A slat was prepared by disposing ribs in the length direction of the main body in addition to the structure of the slat according to Comparative Example 3 (with reference to and FIG. 9D).

Table 1 shows simulation results of displacements, acquired by fixing both sides of the slats prepared according to [Example 1] and [Comparative Example 1] to [Comparative Example 4], provided with the coupling parts formed thereat, and then applying a load of 180 kg in the −Z direction to the upper surfaces of the stepping parts of the respective slats, using a numerical analysis program.

TABLE 1

| | Displacement of Central Area | Displacement of Off-centered Area |
|---|---|---|
| Example | −2.6 mm | −1.6 mm |
| Comparative Example 1 | −3.1 mm | −1.8 mm |

TABLE 1-continued

| | Displacement of Central Area | Displacement of Off-centered Area |
|---|---|---|
| Comparative Example 2 | −4.1 mm | −2.4 mm |
| Comparative Example 3 | −9.5 mm | −6.0 mm |
| Comparative Example 4 | −6.9 mm | −4.4 mm |

Each of the displacements of the central areas of the slats according to Example, Comparative Example 1 and Comparative Example 2 indicated the mean value of the displacements of three places in the width direction at the center of the upper surface of the main body of a corresponding one of the respective slats, measured by applying the load in the downward direction thereto, and each of the displacements of the central areas of the slats according to Comparative Example 3 and Comparative Example 4 indicated the mean value of the measured displacements of two places in the width direction, due to the structure of the rectangular pillars. The results showed that the displacement of the slat according to Example configured such that the load is distributed is less than the displacements of the slats according to Comparative Examples 1 to 4 (with reference to FIG. 8(*a*) FIG. 8A and FIG. 9 FIGS. 9A-9D). Further, each of the displacements of off-centered areas of the slats according to Example, Comparative Example 2, Comparative Example 3 and Comparative Example 4 indicated the mean value of the measured displacements of three places in the width direction in one spot deviating sidewards from the center of the upper surface of the main body of a corresponding one of the respective slats, measured by applying the load in the downward direction thereto, and the displacement of an off-centered area of the slat according to Comparative Example 1 indicated the mean value of the measured displacements of two places in the width direction, due to the structure of the ribs.

The results showed that the displacement of the slat according to Example configured such that the load is distributed is less than the displacements of the slats according to Comparative Examples 1 to 4, and thus, it was proved that the performance of the slat according to Example of the present invention is excellent compared to the slats according to Comparative Examples (with reference to FIG. 8B and FIGS. 9A-9D).

In the slat having the truss structure according to the present invention, the load applied to the stepping part is distributed by the diagonal member part and the chord member part of the truss part, and thereby, bending of the main body due to the load may be minimized and damage to the slat may be minimized.

Figure 10:
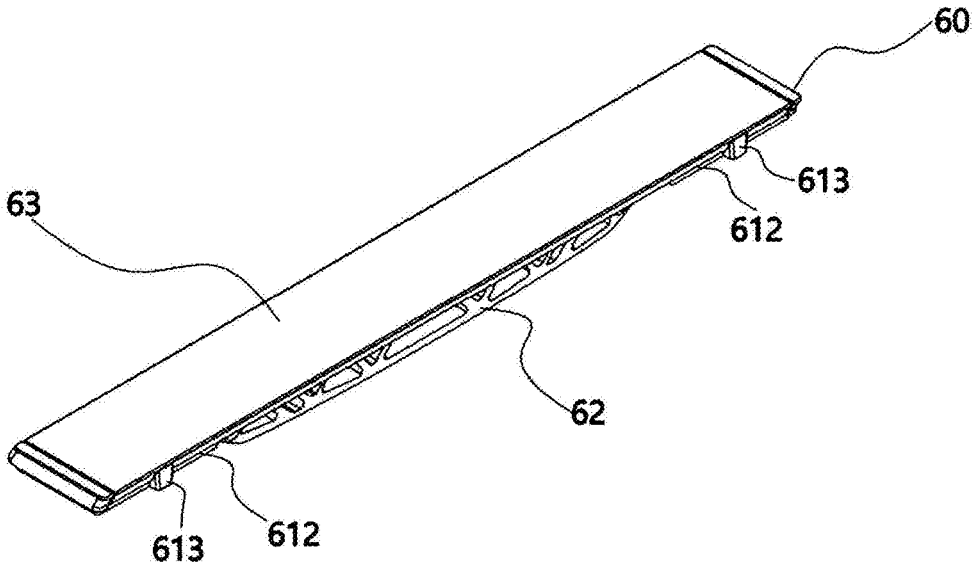
FIG. 10 is a view illustrating the slat (60) further including a shock absorber (63) according to one embodiment of the present invention.
Figure 11:
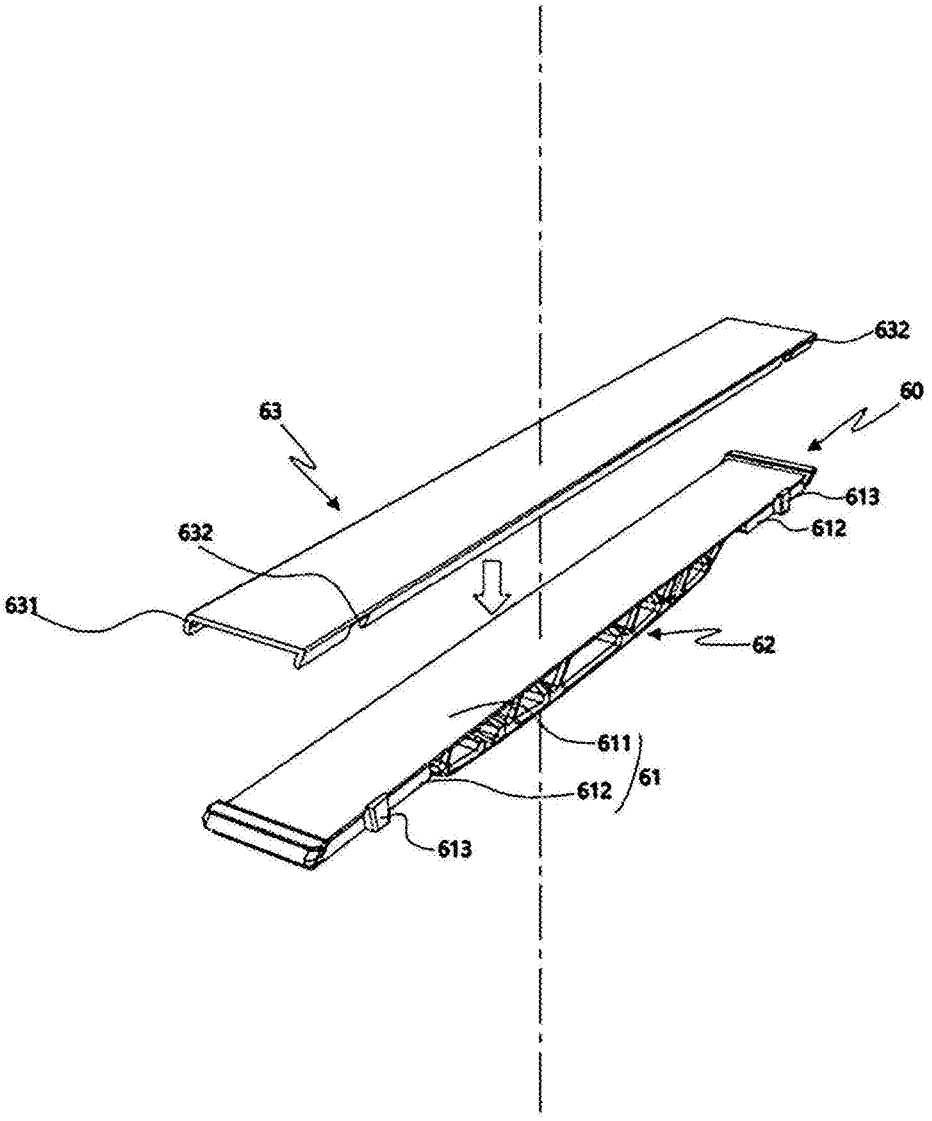
FIG. 11 is a view illustrating combination relations between the shock absorber (63) and a main body (61) according to one embodiment of the present invention.

Further, as shown in FIGS. 10 and 11, the slat according to the present invention may further include a cover 63 combined with the upper portion of the main body 61 so as to mitigate shock generated when the user steps thereon. The cover 63 serves to subsidiarily mitigate shock generated when the user steps on the slat so as to prevent the main body 61 and the truss part 62 from being bent and damaged. The cover 63 may be produced integrally with the slat through injection molding.

Although the embodiments of the present invention have been disclosed for illustrative purposes, those skilled in the art will appreciate that various modifications, additions and substitutions are possible, without departing from the scope and spirit of the invention as disclosed in the accompanying claims.

(Description of Reference Numerals and Marks)

| | |
|---|---|
| 1: treadmill | 10: body |
| 20a: first roller | 20b: second roller |
| 30: track belt | 31: fastening unit |
| 40: frame unit | 41: handle |
| 50: controller | 60: slat |
| 61, 61-1: main body | 61a: one side surface |
| 61b: remaining side surface | 61W: width of main body |
| 611: stepping part | 612: coupling part |
| 613: spacer | 62: truss part |
| 62W: width of truss part | 621: chord member part |
| 621c: virtual central line of chord member part | 622: diagonal member part |
| 623a, 623c: first unit diagonal member | 623b, 623d: second unit diagonal member |
| 624a, 625a, 626a, 627a: first diagonal member | 624b, 625b, 626b, 627b: second diagonal member |
| 63: cover | |

The invention claimed is:

1. A slat having a truss structure moved along track belts, the slat comprising:

a main body comprising a stepping part configured to receive a load of a user and coupling parts formed at both ends of the stepping part so as to be fixed to the track belts; and a truss part connected to the stepping part so as to distribute the load applied to the mart body, wherein the truss part comprises a chord member part spatially spaced apart from the stepping part by a first designated distance, and a diagonal member part configured to connect the chord member part and the stepping part, wherein the diagonal member part comprises first unit diagonal members configured to connect an inner surface of the chord member part to the stepping part, each of the first unit diagonal members comprising at least one first diagonal member inclined in a first direction and arranged in a length direction of the chord member part and the stepping part, and at least one second diagonal member inclined in a second direction opposite to the first direction and arranged in the length direction of the chord member part and the stepping part, wherein one side of the least one first diagonal member is connected to one side of the at least one second diagonal member, and one sides and remaining sides of the at least one first diagonal member and the at least one second diagonal member are respectively connected to the stepping part and the chord member part so as to form a triangular truss structure, wherein the diagonal member part further comprises second unit diagonal members provided adjacent to the first unit diagonal members and configured to connect ends of the chord member part to the stepping part and the coupling parts, and wherein the outermost second diagonal member of the first unit diagonal member and the innermost first diagonal member of the second unit diagonal member are spaced apart from each other by a second designated distance to be opposite each other.

2. The slat according to claim 1, wherein the chord member part is formed to have a curved surface convex in a direction away from the stepping part.

3. The slat according to claim 1, wherein a width of the truss part is smaller than a width of the main body.

4. The slat according to claim 1, wherein one side surface and a remaining side surface of the main body in a width direction thereof are inclined in the same direction.

* * * * *